US008024909B2

(12) United States Patent
Bernhard

(10) Patent No.: US 8,024,909 B2
(45) Date of Patent: Sep. 27, 2011

(54) BEVERAGE BOTTLING PLANT FOR FILLING BOTTLES WITH A LIQUID BEVERAGE FILLING MATERIAL HAVING A RECEIVING TABLE FOR THE CONTAINER HANDLING MACHINES THEREIN

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 957 days.

(21) Appl. No.: 11/245,948

(22) Filed: Oct. 7, 2005

(65) Prior Publication Data

US 2006/0086061 A1 Apr. 27, 2006

(30) Foreign Application Priority Data

Oct. 9, 2004 (DE) ..... 10 2004 049 330

(51) Int. Cl.
*B65B 5/00* (2006.01)
*B31B 1/70* (2006.01)

(52) U.S. Cl. ..... 53/253; 493/89

(58) Field of Classification Search ..... 53/253, 53/331.5, 317, 319
See application file for complete search history.

(56) References Cited

U.S. PATENT DOCUMENTS 2,995,882 A 8/1961 Barnby
5,713,403 A * 2/1998 Clusserath et al. ..... 141/101

FOREIGN PATENT DOCUMENTS

| | | | |
|---|---|---|---|
| DE | 10 52 844 | B | 3/1959 |
| DE | 12 09 905 | B | 1/1966 |
| DE | 33 27 492 | A1 | 2/1985 |
| DE | 37 17 338 | A1 | 3/1988 |
| DE | 195 12 849 | A1 | 10/1996 |
| DE | 298 05 957 | U1 | 8/1998 |
| DE | 197 40 373 | A1 | 3/1999 |
| DE | 198 14 625 | A1 | 10/1999 |
| DE | 200 02 483 | U1 | 5/2001 |
| DE | 200 19 305 | U1 | 6/2001 |

* cited by examiner

*Primary Examiner* — Rinaldi I. Rada
*Assistant Examiner* — John Paradiso
(74) *Attorney, Agent, or Firm* — Nils H. Ljungman & Associates

(57) ABSTRACT

A beverage bottling plant for filling bottles with a liquid beverage filling material having a receiving table for the container handling machines therein.

20 Claims, 4 Drawing Sheets

BEVERAGE BOTTLING PLANT FOR FILLING BOTTLES WITH A LIQUID BEVERAGE FILLING MATERIAL HAVING A RECEIVING TABLE FOR THE CONTAINER HANDLING MACHINES THEREIN

BACKGROUND

1. Technical Field

The present application relates to a beverage bottling plant for filling bottles with a liquid beverage filling material having a receiving table or unscrambling table or setup table or prep table for the container handling machines therein.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Container handling machines are regularly used for the production of beverages in the beverage industry. These machines include, among other things, rinsers, fillers, cappers and labeling machines.

These handling machines can be linear machines, but they can also be rotary machines. Because both types of machines are amply described in prior art documents, there is no need to provide a more detailed description at this point. The accompanying figures show only rotary machines, although this is in no way intended to limit the scope of the present application to rotary machines.

The containers to be handled, e.g. bottles, cans or beverage cartons, to and from these container handling machines are generally fed to and removed from these container handling machines by means of single-track conveyors, whereby the containers are transferred between the conveyor and the handling machine or between the handling machine and the conveyor by means of inlet or outlet star wheels of the prior art.

It has been found to be altogether advantageous to combine the inlet and outlet star wheels and the elements for the mechanical connection of these star wheels with at least one of the container handling machines that is present into what is called a receiving table or an unscrambling table or a setup table or a prep table. Thereby additional elements, such as feed worms, housings or control elements of the container handling machines, can also be components of this receiving table.

Because such receiving tables, with all their attendant advantages, represent a significant cost factor on account of the complexity of their design and construction, and the constructions that are disclosed in the prior art had numerous individual surfaces, edges, corners and undercuts that offered starting points for undesirable contamination, multiple attempts have been made in the past to simplify and improve receiving tables with regard to their manufacture, costs and hygiene or cleaning.

Thus, for example, the unexamined German Patent Application DE 195 12 849 presents a variant of a receiving table in which the receiving table comprises essentially a flat, relatively thick metal plate which is oriented three-dimensionally at a specified angle with respect to the horizontal. This prior art also teaches that spraying devices are provided on the higher edge of the metal plate and collecting gutters on the lower edge.

For the cleaning and/or disinfection of this device of the prior art, cleaning fluid is sprayed onto the metal plate by the sprayer devices. As a result of the inclined orientation of the metal plate there is a directed flow of the cleaning agent, by which any dirt or contamination that may adhere to the metal place is supposed to be rinsed off.

One of several disadvantages of a device of this type is that the metal plates used require a large amount of material, and the mechanical processing of this material is complicated, time-consuming and expensive on account of the numerous borings that have to be introduced into these plates at specified angles.

DE 200 02 483 U1 describes another receiving table of the prior art. This prior art patent describes a receiving table that has an essentially rectangular base body, whereby this base body is provided with a superstructure in the shape of a hip roof made of sheet metal.

This hip-roof-shaped superstructure is in turn interrupted in the vertical plane by the mountings or receptacles for inlet or outlet star wheels, cappers etc.

Of course a receiving table of the type described in DE 200 02 483 U1 uses significantly less material compared to other realizations, although the fabrication of the hip-roof superstructure frequently poses technical difficulties.

DE 298 05 957 describes another configuration which reduces the number of components and areas present on receiving tables of the prior art to the bare essentials. For example, receiving tables as described in DE 298 05 957 first comprise a base body which is assembled from elements in the shape of truncated cones, whereby these elements are connected by straight connecting pieces, the upper side of which has a gable-roof shape.

Such receiving tables also comprise conical and/or columnar elements which extend vertically upward starting from the base body and support devices on their upper end, such as transport star wheels, cappers, feed worms etc.

As a result of the extremely advantageous configuration of a receiving table of this type, the manufacturing and cleaning during operation become much simpler, and the associated costs are reduced accordingly. However, improvements can still be made in the amount of material required for the base body.

OBJECT OR OBJECTS

The object is to eliminate the disadvantages of the receiving tables of the prior art for container handling machines such as, for example, the large amount of material that is required, and the related high manufacturing costs and large surface areas with disadvantageous configurations that tend to collect dirt and contaminants. The present application teaches that the receiving tables of the prior art can be replaced by a simple frame or brace construction with optimized or reduced surfaces.

The above-discussed embodiments of the present application will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is described in greater detail below with reference to one exemplary embodiment as illustrated in the accompanying figures, in which.

DESCRIPTION OF EMBODIMENT OR EMBODIMENTS

Figure 1A:
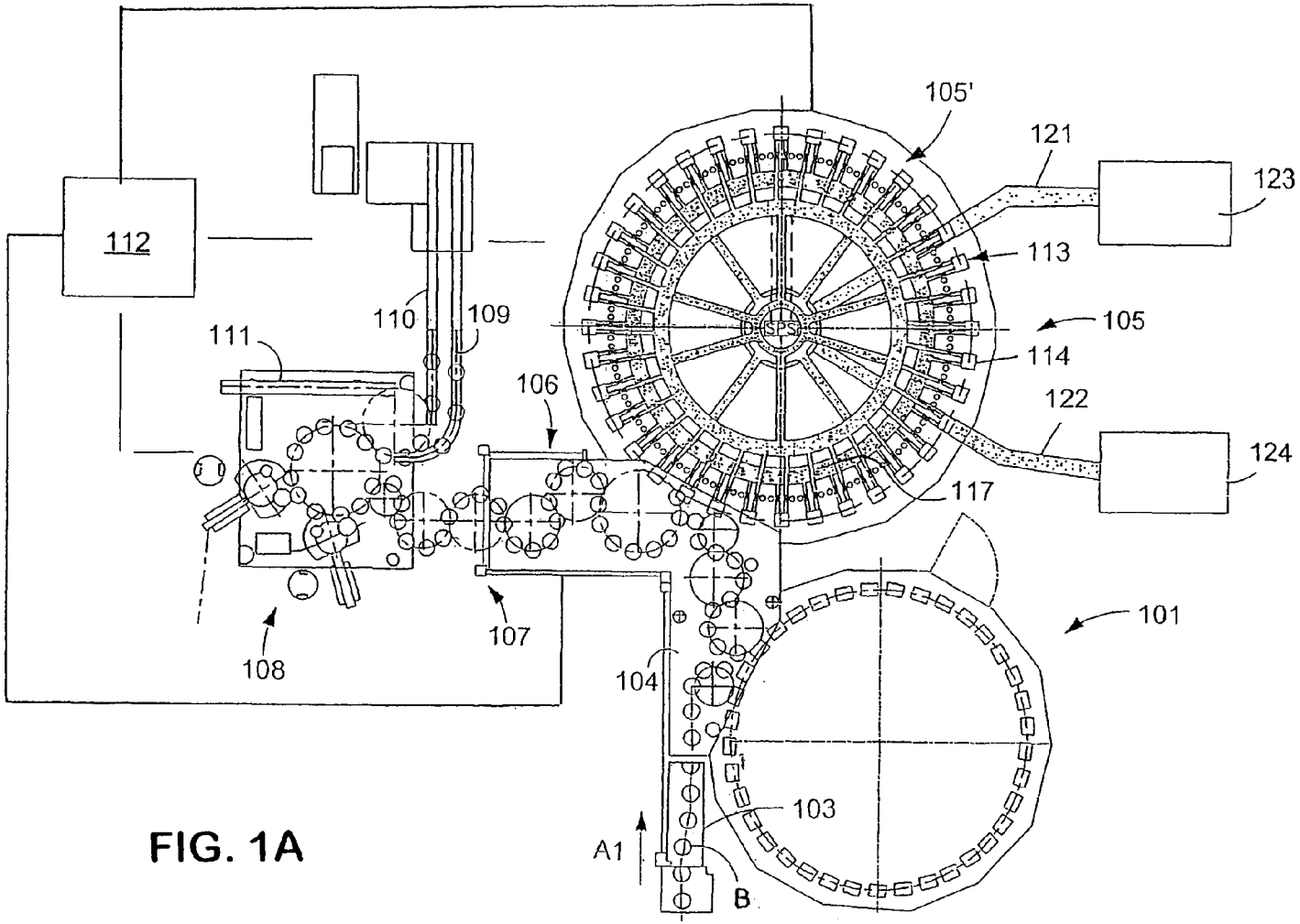
FIG. 1A is a schematic illustration of a container filling plant in accordance with one possible embodiment.

Developments, advantages and potential applications of the present application will be apparent from the following description of exemplary embodiments and the accompanying drawings. All the features described and/or illustrated in the drawings, in themselves or in any arbitrary combination, are the object of the present application, regardless of their placement in the claims or the references between claims. The text of the claims is also incorporated by reference into the description.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 1:
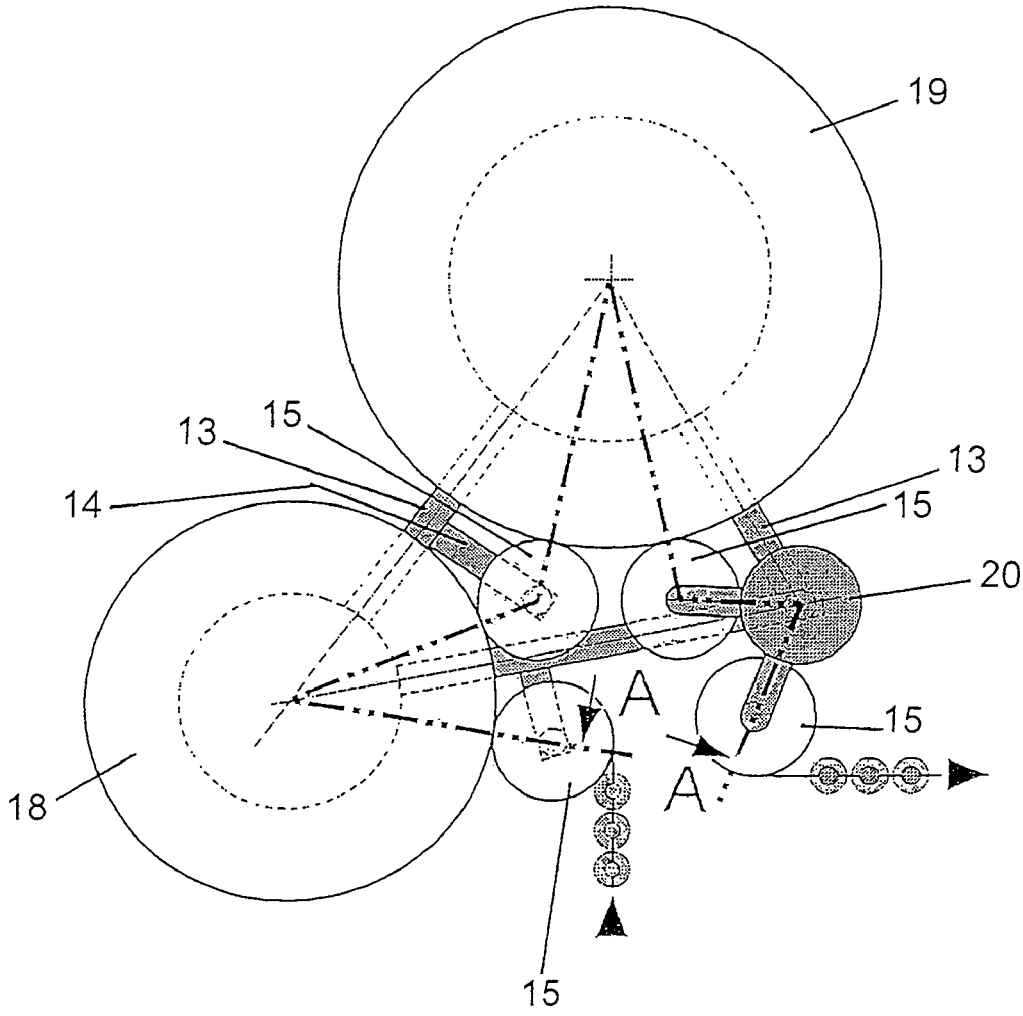
FIG. 1 shows, in a simplified plan view from overhead, an arrangement of rinser, filler and capping machine with inlet and outlet star wheels, equipped with a receiving table as claimed by the present application.

As shown in FIG. 1, a receiving table as claimed by the present application comprises essentially bar-shaped or rod-shaped connecting elements 13 which on one hand connect the individual container handling machines, in this case the rinser 18, filler 19 and capper 20, with one another and on the other hand serve as mountings for the corresponding transport star wheels 15, i.e. the inlet, outlet and transfer star wheels, and/or offer fastening fixtures for these star wheels.

In the exemplary embodiment illustrated, the container handling machines used are joined together by the associated connecting elements 13 in the form of a triangle, which is particularly advantageous in terms of the stability that can be achieved.

The connecting elements are advantageously fastened between or to the foundation rings 21 of the container handling machines. The receptacles 14 for the transport star wheels 15 and/or the transport star wheels 15 themselves are fastened to said connecting elements 13 in a suitable manner.

The connecting elements 13 can be tubes, for example, which have a round, triangular, rectangular or polygon shape, although the cross section of the connecting elements can also be any desired shape, e.g. profiles formed by compression across the edges, die casting, extrusion, rolling or similar processes.

The scope of protection of this application also includes those configurations which, in contrast to the exemplary embodiment illustrated in FIG. 1, use connecting elements 13 that have a shape that is not essentially straight, e.g. connecting elements 13 that are curved or bent at an angle.

Figure 2:
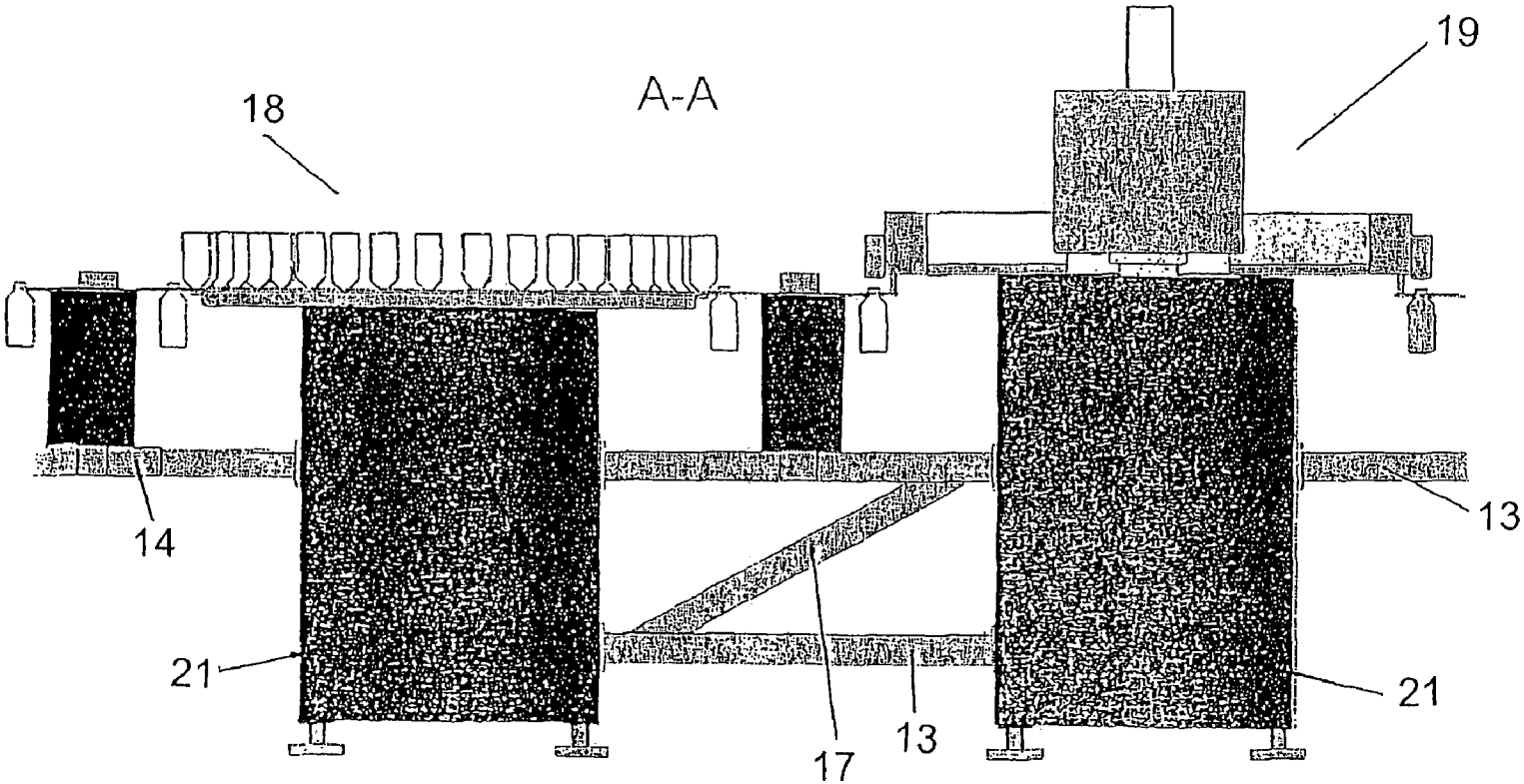
FIG. 2 is a simplified side view of one exemplary embodiment with a rinser 18 and a filling machine 19.
Figure 4:
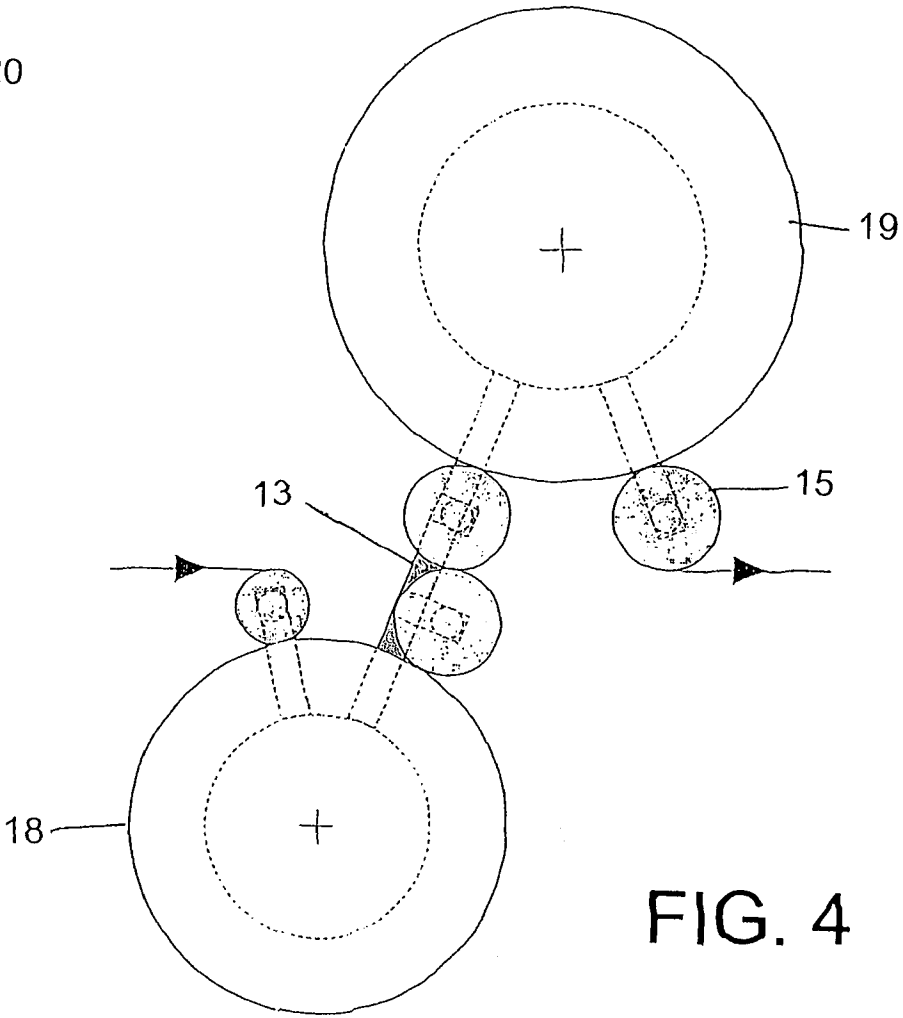
FIG. 4 shows an additional exemplary embodiment with two container handing machines.
Figure 3:
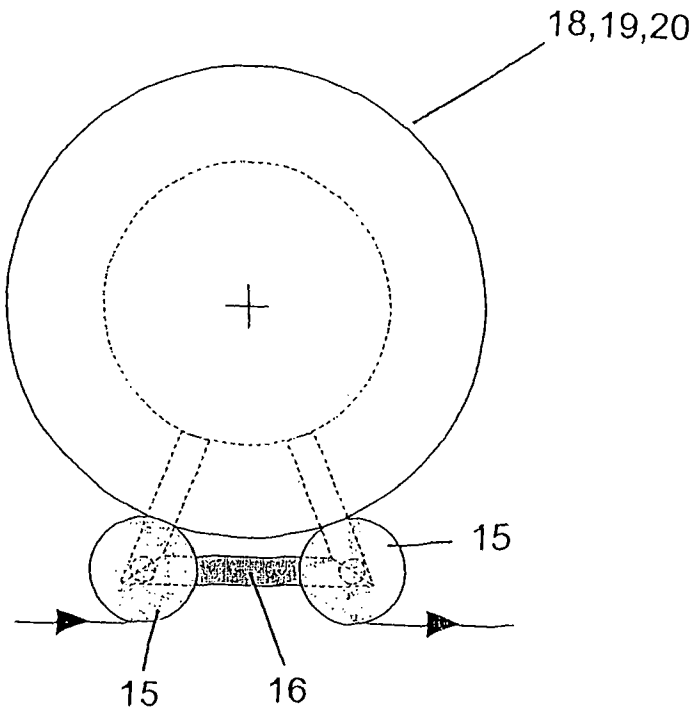
FIG. 3 a configuration with a container handing machine and the corresponding transport star wheels.

In a further realization, the present application teaches that not only combinations of container handling machines can be connected in the manner illustrated in FIGS. 1 and 2. The present application also teaches that individual container handling machines, such as a filling machine 19, for example, can be connected in the manner taught by the present application with the necessary transport star wheels 15 (FIG. 3).

The present application teaches first that the connecting elements 13 are fastened to the foundation ring 21 of the container handling machine so that the connecting elements extend outward essentially radially from the midpoint of the container handling machine. The receptacles 14 for the transport star wheels 15 are located on these connecting elements 13.

For the case in which there is a requirement for increased stability, the present application also teaches that the connecting elements 13 that extend radially outward can be reinforced by an additional bracing element 16 that is located between them.

The scope of the present application also extends to configurations in which the connecting elements 13 are not fastened to the foundation rings 21 in the manner described above. In such configurations, the connecting elements 13 can, for example, be connected to the foundation rings 21 tangentially or at any arbitrary angle.

As illustrated in FIG. 2, the present application also teaches that the connecting elements 13 are not only located in one single vertical level, but that they can also be located in a plurality of vertical levels, and that they can extend over a plurality of vertical levels. In an additional configuration, the present application teaches that the connecting elements 13 located on different vertical levels can be connected by vertical braces 17, which results in additional advantages in terms of stability.

For an additional and altogether advantageous configuration, the present application teaches that the shape of the cross section surface of the connecting elements 13 can be realized so that the connecting elements do not have any external surfaces on which fluids or dirt can collect and/or be deposited. This feature is achieved essentially because the upper external surfaces of the connecting elements 13 are not realized in the horizontal orientation but in an angled or inclined orientation and/or in the form of circular or convexly curved surfaces.

The present application further teaches that on the ends of the connecting elements 13, on at least one end there are elements to adjust and/or orient the connecting elements 13 and/or the container handling machines.

The scope of protection of the present application also includes the case in which, instead of the essentially bar-shaped or rod-shaped connecting elements 13, flat connecting elements, e.g. connecting elements made of sheet metal or a similar material, are used.

Certain types of container handling machines require inlet star wheels or feed worms, the purpose of which is to arrange the containers that are all jammed up at the intervals required by the machine.

Certain types of container handling machines also require guide elements to safely and smoothly guide the containers through the container handling machines, whereby the guides in question can be internal or external guides, for example. The containers can also be fed to and removed from certain container handling machines using conveyor belts.

In the context of the present application, at least these elements, i.e. the feed worms, guide elements and conveyor belts, can also be fastened directly or indirectly to the connecting elements 13. Thus the above description, in the sections that relate to transport star wheels 15, must be understood as meaning that the location and arrangement of these container transport elements on the connecting elements 13 is also disclosed, if and to the extent that said additional container transport elements are appropriate in this location.

In the context of an additional configuration of the embodiments, the present application teaches that there are coverings or a housing to protect against noise, accidents or contact, of the type that are frequently provided on container handling machines, are located or fastened directly or indirectly on the connecting elements 13. This feature has additional advantages in terms of cleaning and reduced costs.

The configurations taught in the context of the present application have significant advantages. Thus, for example, the cleaning and/or disinfection operations are simpler and cheaper on account of the reduced size of the surface and the improved configuration. The use of the connecting elements 13 taught by the present application significantly reduces the manufacturing costs and the amount of time required for the assembly and installation of the container handling machines.

According to another possible embodiment, the connecting elements 13 could be oblong connecting elements comprising a length, a width, and a thickness. In this possible embodiment, the length could be substantially greater than either of the width and the thickness. For example, the length could be at least twice as long as either of the width and the thickness. The oblong connecting elements could possibly span between two machines in a beverage bottling plant, such as the filling machine and the capping machine. In addition, the oblong connecting elements could possibly span between three machines in a beverage bottling plant, such as the filling machine, the capping machine, and the labeling machine. It should be noted that there are any number of possible configurations of the oblong connecting elements and the receiving tables in a beverage bottling plant, and the above descriptions are not meant to limit the present applications in any way.

In other possible embodiments, the receiving tables could comprise one oblong connecting member on one vertical level with no vertical brace. In addition, in other possible embodiments, the receiving tables could comprise two oblong connecting members on two different vertical levels with a vertical brace. It should be noted that any number of oblong connecting members are possible in different configurations of the receiving table, and the above descriptions are not meant to limit the present application in any way.

The present application relates to a receiving table for container handling machines such as, for example, rinsers, filling machines or capping machines, for the handling of containers such as, for example, bottles, cans, beverage cartons etc. made of glass, plastic or cardboard, whereby that the present application teaches that the receiving table comprises essentially connecting elements which form at least the receptacles for the container transport elements of a container handling machine and/or connect two or more container handling machines with one another.

German Patent Application No. 10 2004 050 397.4, and the English translation thereof, are incorporated by reference as if set forth in their entirety therein.

One feature or aspect of an embodiment is believed at the time of the filing of this patent application to possibly reside broadly in an unscrambling table for container handling machines such as, for example, rinsers, filling machines or capping machines, for the handling of containers such as, for example, bottles, cans, beverage cartons etc. made of glass, plastic or cardboard, characterized by the fact that the unscrambling table consists essentially of connecting elements which form at least the receptacles for the container transport elements of a container handling machine and/or connect two or more container handling machines with each other.

Another feature or aspect of an embodiment is believed at the time of the filing of this patent application to possibly reside broadly in an unscrambling table, characterized by the fact that the connecting elements are bar-shaped or rod-shaped elements.

Yet another feature or aspect of an embodiment is believed at the time of the filing of this patent application to possibly reside broadly in an unscrambling table, characterized by the fact that the connecting elements are flat elements.

Still another feature or aspect of an embodiment is believed at the time of the filing of this patent application to possibly reside broadly in an unscrambling table, characterized by the fact that the container transport elements are transport star wheels and/or feed worms and/or container guides and/or conveyor belts.

A further feature or aspect of an embodiment is believed at the time of the filing of this patent application to possibly reside broadly in an unscrambling table in one of the connecting elements connect a rinser, a filling machine and the corresponding container transport elements with one another.

Another feature or aspect of an embodiment is believed at the time of the filing of this patent application to possibly reside broadly in an unscrambling table, characterized by the fact that the connecting elements connect a filling machine and a capping machine and the corresponding container handling elements with one another.

Still another feature or aspect of an embodiment is believed at the time of the filing of this patent application to possibly reside broadly in an unscrambling table, characterized by the fact that the connecting elements connect a rinser, a filling machine and a capping machine and the corresponding container transport elements with one another.

Yet another feature or aspect of an embodiment is believed at the time of the filing of this patent application to possibly reside broadly in an unscrambling table, characterized by the fact that the connecting elements connect the container handling machines and/or the container transport elements with one another at least partly in the shape of a triangle.

Still another feature or aspect of an embodiment is believed at the time of the filing of this patent application to possibly reside broadly in an unscrambling table, characterized by the fact that the connecting elements are located on different vertical levels.

A further feature or aspect of an embodiment is believed at the time of the filing of this patent application to possibly reside broadly in an unscrambling table, characterized by the fact that the connecting elements extend over a plurality of vertical levels.

Another feature or aspect of an embodiment is believed at the time of the filing of this patent application to possibly reside broadly in an unscrambling table, characterized by the fact that connecting elements located on a plurality of vertical levels are connected to one another by vertical braces.

Yet another feature or aspect of an embodiment is believed at the time of the filing of this patent application to possibly reside broadly in an unscrambling table, characterized by the fact that the external configuration of the cross section surface of the connecting elements has no horizontal surfaces.

Still another feature or aspect of an embodiment is believed at the time of the filing of this patent application to possibly reside broadly in an unscrambling table, characterized by the fact that the connecting elements have external surfaces that are angled and/or inclined and/or circular and/or convexly curved.

A further feature or aspect of an embodiment is believed at the time of the filing of this patent application to possibly reside broadly in an unscrambling table, characterized by the fact that on at least one end of the connecting elements there are elements for the orientation and/or adjustment of the connecting elements and/or of the container handling machines.

Another feature or aspect of an embodiment is believed at the time of the filing of this patent application to possibly reside broadly in an unscrambling table, characterized by the fact that the connecting elements are fastened to the foundation rings of the container handling machines.

Yet another feature or aspect of an embodiment is believed at the time of the filing of this patent application to possibly reside broadly in an unscrambling table, characterized by the fact that fastened to the connecting elements, directly or indirectly, are elements for the covering or housing of the container handling machines.

Some examples of bottling systems, which may be used or adapted for use in at least one possible embodiment of the present may be found in the following U.S. Patents assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078, 826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The appended drawings in their entirety, including all dimensions, proportions and/or shapes in at least one embodiment of the invention, are accurate and are hereby included by reference into this specification.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All, or substantially all, of the components and methods of the various embodiments may be used with at least one embodiment or all of the embodiments, if more than one embodiment is described herein.

Some examples of servo-motors that may possibly be utilized or possibly adapted for use in at least one possible embodiment of the present application may possibly be found in the following U.S. Pat. No. 4,050,434 issued to Zbikowski et al, on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al, on Aug. 2, 1988; U.S. Pat. No. 5,076,568 issued to de Jong et al, on Dec. 31, 1991; and U.S. Pat. No. 6,025,684 issued to Yasui on Feb. 15, 2000.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

All of the patents, patent applications and publications recited herein, and in the Declaration attached hereto, are hereby incorporated by reference as if set forth in their entirety herein.

Some examples of apparatus and methods of sterilizing or cleaning containers that may possibly be utilized or possibly adapted for use in at least one possible embodiment of the present application may possibly be found in the following U.S. Patents: U.S. Pat. No. 5,092,356 issued to Grot on Mar. 3, 1992; U.S. Pat. No. 5,320,144 issued to Ahlers on Jun. 14, 1994; U.S. Pat. No. 5,533,552 issued to Ahlers on Jul. 9, 1996; U.S. Pat. No. 5,558,135 issued to Kronseder et al. on Sep. 24, 1996; and U.S. Pat. No. 5,896,899 issued to Schlitz on Apr. 27, 1999.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of container processing apparatus that may possibly be utilized or possibly adapted for use in at least one possible embodiment of the present application may possibly be found in the following U.S. Patents: U.S. Pat. No. 4,241,848 issued to Young on Dec. 30, 1980; U.S. Pat. No. 4,382,422 issued to Eddy et al. on May 10, 1983; and U.S. Pat. No. 4,720,797 issued to Sommerfield et al. on Jan. 19, 1988.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of container processing apparatus that may possibly be utilized or possibly adapted for use in at least one possible embodiment of the present application may possibly be found in the following U.S. Patents: U.S. Pat. No. 4,241,848 issued to Young on Dec. 30, 1980; U.S. Pat. No. 4,382,422 issued to Eddy et al. on May 10, 1983; and U.S. Pat. No. 4,720,797 issued to Sommerfield et al. on Jan. 19, 1988.

The corresponding foreign patent publication applications, namely, Federal Republic of Germany Patent Application No. 10 2004 049 330.8, filed on Oct. 9, 2004, having inventor Herbert Bernhard, and DE-OS 10 2004 049 330.8 and DE-PS 10 2004 049 330.8, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587,entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A bottle filling plant for filling bottles with a filling material, said bottle filling plant comprising:

a plurality of machines;

said plurality of machines comprising at least a bottle rinsing machine, a bottle filling machine and a bottle closing machine;

a first star wheel being configured and disposed to move bottles to said rinsing machine;

said rinsing machine being configured and disposed to rinse empty bottles with a rinsing material;

said rinsing machine comprising:

a moving device being configured and disposed to accept bottles from said first star wheel and to move bottles within said rinsing machine;

an apparatus being configured and disposed to hold bottles during rinsing; and at least one rinsing device being configured and disposed to rinse bottles with a rinsing material upon the bottles being within said rinsing machine;

a second star wheel being configured and disposed to move bottles between said rinsing machine and said filling machine;

said filling machine being configured and disposed to fill empty bottles with a filling material;

said filling machine comprising:

a moving device being configured and disposed to accept bottles from said second star wheel and to move bottles within said filling machine;

an apparatus being configured and disposed to hold bottles during filling; and at least one filling device being configured and disposed to fill bottles with a filling material upon the bottles being within said filling machine;

a third star wheel being configured and disposed to accept filled bottles from said moving device of said filling machine to move filled bottles out of said filling machine;

said third star wheel being configured and disposed to move filled bottles between said filling machine and said closing machine;

said closing machine being configured and disposed to close filled bottles;

said closing machine comprising:

a moving device being configured and disposed to accept filled bottles from said third star wheel and to move filled bottles within said closing machine;

an apparatus being configured and disposed to hold filled bottles during closing; and at least one closing device being configured and disposed to close filled bottles upon the filled bottles being within said closing machine;

a fourth star wheel being configured and disposed to accept closed bottles from said moving device of said closing machine to move closed bottles out of said closing machine;

a plurality of oblong connecting elements being disposed and configured to minimize collection of contaminants and facilitate cleaning of said connecting elements;

each of said plurality of oblong connecting elements comprising a first end and a second end;

each of said plurality of oblong connecting elements comprising a length, a width, and a thickness, said length of each of said plurality of oblong connecting elements being substantially greater than either of said width and said thickness to form a bar-shaped or rod-shaped element;

said width and said thickness being sufficiently great to provide sufficient rigidity to said connecting elements to hold said machines sufficiently rigidly with respect to one another to minimize movement of said machines with respect to one another and to minimize misalignment of said machines with respect to one another during operation but also being disposed and configured to minimize collection of contaminants and facilitate cleaning of said connecting elements;

each said first end being disposed at one end of said length of its oblong connecting element and each said second end being disposed at the other end of said length of its oblong connecting element opposite and most distantly disposed from said first end;

said plurality of oblong connecting elements comprising:

a first, top, set of connecting elements being disposed and configured to minimize collection of contaminants and facilitate cleaning of said connecting elements and having a length dimension being disposed substantially horizontally;

said first, top, set of connecting elements comprising:

a first, top, connecting element being disposed between and mechanically and operatively connected to said rinsing machine and to said filling machine and having a first end mechanically and operatively connected to said rinsing machine and having a second end mechanically and operatively connected to said filling machine;

a second, top, connecting element being disposed between and mechanically and operatively connected to said filling machine and to said closing machine and having a first end mechanically and operatively connected to said filling machine and having a second end mechanically and operatively connected to said closing machine;

a third, top, connecting element being disposed between and mechanically and operatively connected to said closing machine and to said rinsing machine and having a first end mechanically and operatively connected to said closing machine and having a second end mechanically and operatively connected to said rinsing machine; and said first, top, connecting element, said second, top, connecting element, and said third, top, connecting element being disposed to form a triangular structure to provide sufficient rigidity between said machines to minimize movement of said machines with respect to one another and to minimize misalignment of said machines with respect to one another during operation but also being disposed and configured to minimize collection of contaminants and facilitate cleaning of said connecting elements;

said plurality of oblong connecting elements further comprising:

a second, bottom, set of connecting elements being disposed and configured to minimize collection of contaminants and facilitate cleaning of said connecting elements and having a length dimension being disposed substantially horizontally;

said second, bottom, set of connecting elements comprising:

a first, bottom, connecting element being disposed between and mechanically and operatively connected to said rinsing machine and to said filling machine and having a first end mechanically and operatively connected to said rinsing machine and having a second end mechanically and operatively connected to said filling machine;

said first, bottom, connecting element being disposed immediately below said first, top, connecting element and the distance between said first, bottom connecting element and said first, top, connecting element is at least substantially similar to the length of either of said first, bottom, connecting element and said first, top, connecting element;

a second, bottom, connecting element being disposed between and mechanically and operatively connected to said filling machine and to said closing machine and having a first end mechanically and operatively connected to said filling machine and having a second end mechanically and operatively connected to said closing machine;

said second, bottom, connecting element being disposed immediately below said second, top, connecting element and the distance between said second, bottom connecting element and said second, top, connecting element is at least substantially similar to the length of either of said second, bottom, connecting element and said second, top, connecting element;

a third, bottom, connecting element being disposed between and mechanically and operatively connected to said closing machine and to said rinsing machine and having a first end mechanically and operatively connected to said closing machine and having a second end mechanically and operatively connected to said rinsing machine;

said third, bottom, connecting element being disposed immediately below said third, top, connecting element and the distance between said third, bottom connecting element and said third, top, connecting element is at least substantially similar to the length of either of said third, bottom, connecting element and said third, top, connecting element; and said first, bottom connecting element, said second bottom connecting element, and said third, bottom, connecting element being disposed to form a triangular structure to provide sufficient rigidity between said machines to minimize movement of one machine with respect to another machine and to minimize misalignment of said machines with respect to one another during operation but also being disposed and configured to minimize collection of contaminants and facilitate cleaning of said connecting elements;

said plurality of oblong connecting elements still further comprising:

a third, angled, set of connecting elements being disposed and configured to minimize collection of contaminants and facilitate cleaning of said connecting elements;

said third, angled, set of connecting elements being operatively and mechanically connected to said first, top, set of connecting elements and said second, bottom, connecting elements;

said third, angled, set of connecting elements having their lengths being disposed at a non-zero angle with respect to the lengths of said first, top, set of connecting elements and the lengths of said second, bottom, set of connecting elements; and said third, angled, set of connecting elements comprising:

a first, angled, connecting element being disposed between and being mechanically and operatively connected to said rinsing machine and said filling machine and having a first end mechanically and operatively connected to said rinsing machine and having a second end mechanically and operatively connected to said filling machine; and said first, angled, connecting element being disposed between and being mechanically and operatively connected to said first, top, connecting element and said first, bottom, connecting element;

said first, top, set of connecting elements, said second, bottom, set of connecting elements, and said third, angled, set of connecting elements being disposed with respect to one another to at least substantially form a z-shaped configuration;

said rinsing machine, said first, top, connecting element and said first, angled, connecting element being disposed with respect to one another to form a substantially triangular structure to provide sufficient rigidity to hold said machines sufficiently rigidly with respect to one another to minimize movement of one machine to with respect to another machine to minimize misalignment of said machines with respect to one another during operation but also disposed and configured to minimize collection of contaminants and facilitate cleaning of said connecting elements; and said filling machine, said first, bottom, connecting element, and said first, angled, connecting element being disposed with respect to one another to form a substantially triangular structure to provide sufficient rigidity to hold said machines sufficiently rigidly with respect to one another to minimize movement of one machine to with respect to another machine to minimize misalignment of said machines with respect to one another during operation but also disposed and configured to minimize collection of contaminants and facilitate cleaning of said connecting elements;

said plurality of oblong connecting elements further comprising:

a fourth, supporting, set of connecting elements being disposed and configured to minimize collection of contaminants and facilitate cleaning of said connecting elements and having a length dimension being disposed substantially horizontally;

said fourth, supporting, set of connecting elements being configured to receive and support at least one of: said first star wheel, said second star wheel, said third star wheel, and said fourth star wheel; and said fourth, supporting, set of connecting elements comprising:

a first, supporting, oblong connecting element being disposed and configured to minimize collection of contaminants and facilitate cleaning of said connecting elements and comprising a first end being mechanically and operatively connected to said first star wheel;

a second, supporting, oblong connecting element being disposed and configured to minimize collection of contaminants and facilitate cleaning of said connecting elements and comprising a first end being mechanically and operatively connected to said second star wheel;

a third, supporting, oblong connecting element being disposed and configured to minimize collection of contaminants and facilitate cleaning of said connecting elements and comprising a first end being mechanically and operatively connected to said third star wheel;

a fourth, supporting, oblong connecting element being disposed and configured to minimize collection of contaminants and facilitate cleaning of said connecting elements and comprising a first end being mechanically and operatively connected to said fourth star wheel; and each of said second ends of said first, supporting, oblong connecting element, said second, supporting, oblong connecting element, said third, supporting, oblong connecting element, and said fourth, supporting, oblong connecting element being mechanically and operatively connected to at least one of: said rinsing machine, said filling machine, and said closing machine;

substantial portions of said oblong connecting elements are disposed away from and at a substantial distance from one another, with said distance being substantially greater than either of said width or said thickness of said oblong connecting elements; and said substantial portions of said oblong connecting elements are separated substantially only by air; and at least said first, top, set of connecting elements, said second, bottom, set of connecting elements, and said third, angled, set of connecting elements providing essentially the only rigidity between said machines above floor level and to provide sufficient rigidity to hold said machines sufficiently rigidly with respect to one another and to minimize movement of said machines with respect to one another and to minimize misalignment of said machines with respect to one another during operation.

2. The bottle filling plant according to claim 1, wherein:

said first, supporting, oblong connecting element having its first end mechanically and operatively connected to said first star wheel and having its second end mechanically and operatively connected to said third, top, oblong connecting element and said second end being disposed a substantial distance from said rinsing machine and said closing machine;

said second, supporting, oblong connecting element having its first end mechanically and operatively connected to said second star wheel and having its second end mechanically and operatively connected to said first, top, oblong connecting element and said second end being disposed a substantial distance from said rinsing machine and said filling machine;

said third, supporting, oblong connecting element having its first end mechanically and operatively connected to said third star wheel and having its second end mechanically and operatively and adjacently connected to said closing machine and said second end being disposed a substantial distance from said filling machine; and said fourth, supporting, oblong connecting element having its first end mechanically and operatively connected to said fourth star wheel and having its second end mechanically and operatively and adjacently connected to said closing machine and second end being disposed a substantial distance from said rinsing machine.

3. The bottle filling plant according to claim 2, wherein:

each of said first, top, connecting element, said second, top, connecting element, said third, top, connecting element, said first, bottom, connecting element, said second, bottom, connecting element, and said third, bottom, connecting element are at least virtually exactly horizontal; and each of said first, top, connecting element, said second, top, connecting element, said third, top, connecting element, said first, bottom, connecting element, said second, bottom, connecting element, and said third, bottom, connecting element have all surfaces disposed at an angle with respect to the horizontal and, thus, have no horizontal surfaces.

4. The bottle filling plant according to claim 3, wherein:

said plurality of oblong connecting elements further comprising a fifth, bracing, set of connecting elements being disposed and configured to minimize collection of contaminants and facilitate cleaning of said connecting elements and having a length dimension being disposed substantially horizontally;

said fifth, bracing, set of connecting elements comprising a first, bracing, connecting element having a length dimension being disposed substantially horizontally; and said first, bracing, connecting element being disposed between and mechanically and operatively connected to at least two of: said first star wheel, said second star wheel, said third star wheel and said fourth star wheel.

5. The bottle filling plant according to claim 4, wherein said bottle filling plant comprising at least one of (A), (B), (C), (D), (E), and (F):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element; and (F) said at least one said oblong connecting element being disposed between and mechanically and operatively connected to at least one of: said filling machine, said closing machine, and said rinsing machine and their corresponding transport elements.

6. The bottle filling plant according to claim 5, wherein said bottle filling plant comprising all of (A), (B), (C), (D), (E), and (F):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element; and (F) said at least one said oblong connecting element being disposed between and mechanically and operatively connected to at least one of: said filling machine, said closing machine, and said rinsing machine and their corresponding transport elements.

7. A bottle filling plant for filling bottles with a filling material, said bottle filling plant comprising:

a plurality of machines;

said plurality of machines comprising at least a bottle rinsing machine, a bottle filling machine and a bottle closing machine;

a first star wheel being configured and disposed to move bottles to said rinsing machine;

said rinsing machine being configured and disposed to rinse empty bottles with a rinsing material;

said rinsing machine comprising:

a moving device being configured and disposed to accept bottles from said first star wheel and to move bottles within said rinsing machine;

an apparatus being configured and disposed to hold bottles during rinsing; and at least one rinsing device being configured and disposed to rinse bottles with a rinsing material upon the bottles being within said rinsing machine;

a second star wheel being configured and disposed to move bottles between said rinsing machine and said filling machine;

said filling machine being configured and disposed to fill empty bottles with a filling material;

said filling machine comprising:

a moving device being configured and disposed to accept bottles from said second star wheel and to move bottles within said filling machine;

an apparatus being configured and disposed to hold bottles during filling; and at least one filling device being configured and disposed to fill bottles with a filling material upon the bottles being within said filling machine;

a third star wheel being configured and disposed to accept filled bottles from said moving device of said filling machine to move filled bottles out of said filling machine;

said third star wheel being configured and disposed to move filled bottles between said filling machine and said closing machine;

said closing machine being configured and disposed to close filled bottles;

said closing machine comprising:

a moving device being configured and disposed to accept filled bottles from said third star wheel and to move filled bottles within said closing machine;

an apparatus being configured and disposed to hold filled bottles during closing; and at least one closing device being configured and disposed to close filled bottles upon the filled bottles being within said closing machine;

a fourth star wheel being configured and disposed to accept closed bottles from said moving device of said closing machine to move closed bottles out of said closing machine;

a plurality of oblong connecting elements being disposed and configured to minimize collection of contaminants and facilitate cleaning of said connecting elements;

each of said plurality of oblong connecting elements comprising a first end and a second end;

each of said plurality of oblong connecting elements comprising a length, a width, and a thickness, said length of each of said plurality of oblong connecting elements being substantially greater than either of said width and said thickness to form a bar-shaped or rod-shaped element;

said width and said thickness being sufficiently great to provide sufficient rigidity to said connecting elements to hold said machines sufficiently rigidly with respect to one another to minimize movement of said machines with respect to one another and to minimize misalignment of said machines with respect to one another during operation but also being disposed and configured to minimize collection of contaminants and facilitate cleaning of said connecting elements;

each said first end being disposed at one end of said length of its oblong connecting element and each said second end being disposed at the other end of said length of its oblong connecting element opposite and most distantly disposed from said first end;

said plurality of oblong connecting elements comprising:

a first, top, set of connecting elements being disposed and configured to minimize collection of contaminants and facilitate cleaning of said connecting elements and having a length dimension being disposed substantially horizontally;

said first, top, set of connecting elements comprising:

a first, top, connecting element being disposed between and mechanically and operatively connected to said rinsing machine and to said filling machine and having a first end mechanically and operatively connected to said rinsing machine and having a second end mechanically and operatively connected to said filling machine;

a second, top, connecting element being disposed between and mechanically and operatively connected to said filling machine and to said closing machine and having a first end mechanically and operatively connected to said filling machine and having a second end mechanically and operatively connected to said closing machine;

a third, top, connecting element being disposed between and mechanically and operatively connected to said closing machine and to said rinsing machine and having a first end mechanically and operatively connected to said closing machine and having a second end mechanically and operatively connected to said rinsing machine; and said first, top, connecting element, said second, top, connecting element, and said third, top, connecting element being disposed to form a triangular structure to provide sufficient rigidity between said machines to minimize movement of said machines with respect to one another and to minimize misalignment of said machines with respect to one another during operation but also being disposed and configured to minimize collection of contaminants and facilitate cleaning of said connecting elements;

said plurality of oblong connecting elements further comprising:

a second, bottom, set of connecting elements being disposed and configured to minimize collection of contaminants and facilitate cleaning of said connecting elements and having a length dimension being disposed substantially horizontally;

said second, bottom, set of connecting elements comprising:

a first, bottom, connecting element being disposed between and mechanically and operatively connected to said rinsing machine and to said filling machine and having a first end mechanically and operatively connected to said rinsing machine and having a second end mechanically and operatively connected to said filling machine;

said first, bottom, connecting element being disposed immediately below said first, top, connecting element and the distance between said first, bottom connecting element and said first, top, connecting element is at least substantially similar to the length of either of said first, bottom, connecting element and said first, top, connecting element;

a second, bottom, connecting element being disposed between and mechanically and operatively connected to said filling machine and to said closing machine and having a first end mechanically and operatively connected to said filling machine and having a second end mechanically and operatively connected to said closing machine;

said second, bottom, connecting element being disposed immediately below said second, top, connecting element and the distance between said second, bottom connecting element and said second, top, connecting element is at least substantially similar to the length of either of said second, bottom, connecting element and said second, top, connecting element;

a third, bottom, connecting element being disposed between and mechanically and operatively connected to said closing machine and to said rinsing machine and having a first end mechanically and operatively connected to said closing machine and having a second end mechanically and operatively connected to said rinsing machine;

said third, bottom, connecting element being disposed immediately below said third, top, connecting element and the distance between said third, bottom connecting element and said third, top, connecting element is at least substantially similar to the length of either of said third, bottom, connecting element and said third, top, connecting element; and said first, bottom connecting element, said second bottom connecting element, and said third, bottom, connecting element being disposed to form a triangular structure to provide sufficient rigidity between said machines to minimize movement of one machine with respect to another machine and to minimize misalignment of said machines with respect to one another during operation but also being disposed and configured to minimize collection of contaminants and facilitate cleaning of said connecting elements;

said plurality of oblong connecting elements still further comprising:

a third, angled, set of connecting elements being disposed and configured to minimize collection of contaminants and facilitate cleaning of said connecting elements;

said third, angled, set of connecting elements being operatively and mechanically connected to said first, top, set of connecting elements and said second, bottom, connecting elements;

said third, angled, set of connecting elements having their lengths being disposed at a non-zero angle with respect to the lengths of said first, top, set of connecting elements and the lengths of said second, bottom, set of connecting elements; and said third, angled, set of connecting elements comprising:

a first, angled, connecting element being disposed between and being mechanically and operatively connected to said rinsing machine and said filling machine and having a first end mechanically and operatively connected to said rinsing machine and having a second end mechanically and operatively connected to said filling machine; and said first, angled, connecting element being disposed between and being mechanically and operatively connected to said first, top, connecting element and said first, bottom, connecting element;

said first, top, set of connecting elements, said second, bottom, set of connecting elements, and said third, angled, set of connecting elements being disposed with respect to one another to at least substantially form a z-shaped configuration;

said rinsing machine, said first, bottom, connecting element, and said first, angled, connecting element being disposed with respect to one another to form a substantially triangular structure to provide sufficient rigidity to hold said machines sufficiently rigidly with respect to one another to minimize movement of one machine to with respect to another machine to minimize misalignment of said machines with respect to one another during operation but also disposed and configured to minimize collection of contaminants and facilitate cleaning of said connecting elements; and said filling machine, said first, top, connecting element, and said first, angled, connecting element being disposed with respect to one another to form a substantially triangular structure to provide sufficient rigidity to hold said machines sufficiently rigidly with respect to one another to minimize movement of one machine to with respect to another machine to minimize misalignment of said machines with respect to one another during operation but also disposed and configured to minimize collection of contaminants and facilitate cleaning of said connecting elements;

said plurality of oblong connecting elements further comprising:

a fourth, supporting, set of connecting elements being disposed and configured to minimize collection of contaminants and facilitate cleaning of said connecting elements and having a length dimension being disposed substantially horizontally;

said fourth, supporting, set of connecting elements being configured to receive and support at least one of: said first star wheel, said second star wheel, said third star wheel, and said fourth star wheel; and said fourth, supporting, set of connecting elements comprising:

a first, supporting, oblong connecting element being disposed and configured to minimize collection of contaminants and facilitate cleaning of said connecting elements and comprising a first end being mechanically and operatively connected to said first star wheel;

a second, supporting, oblong connecting element being disposed and configured to minimize collection of contaminants and facilitate cleaning of said connecting elements and comprising a first end being mechanically and operatively connected to said second star wheel;

a third, supporting, oblong connecting element being disposed and configured to minimize collection of contaminants and facilitate cleaning of said connecting elements and comprising a first end being mechanically and operatively connected to said third star wheel;

a fourth, supporting, oblong connecting element being disposed and configured to minimize collection of contaminants and facilitate cleaning of said connecting elements and comprising a first end being mechanically and operatively connected to said fourth star wheel; and each of said second ends of said first, supporting, oblong connecting element, said second, supporting, oblong connecting element, said third, supporting, oblong connecting element, and said fourth, supporting, oblong connecting element being mechanically and operatively connected to at least one of: said rinsing machine, said filling machine, and said closing machine;

substantial portions of said oblong connecting elements are disposed away from and at a substantial distance from one another, with said distance being substantially greater than either of said width or said thickness of said oblong connecting elements; and said substantial portions of said oblong connecting elements are separated substantially only by air; and at least said first, top, set of connecting elements, said second, bottom, set of connecting elements, and said third, angled, set of connecting elements providing essentially the only rigidity between said machines above floor level and to provide sufficient rigidity to hold said machines sufficiently rigidly with respect to one another and to minimize movement of said machines with respect to one another and to minimize misalignment of said machines with respect to one another during operation.

8. The bottle filling plant according to claim 7, wherein:

said first, supporting, oblong connecting element having its first end mechanically and operatively connected to said first star wheel and having its second end mechanically and operatively connected to said third, top, oblong connecting element and said second end being disposed a substantial distance from said rinsing machine and said closing machine;

said second, supporting, oblong connecting element having its first end mechanically and operatively connected to said second star wheel and having its second end mechanically and operatively connected to said first, top, oblong connecting element and said second end being disposed a substantial distance from said rinsing machine and said filling machine;

said third, supporting, oblong connecting element having its first end mechanically and operatively connected to said third star wheel and having its second end mechanically and operatively and adjacently connected to said closing machine and said second end being disposed a substantial distance from said filling machine; and said fourth, supporting, oblong connecting element having its first end mechanically and operatively connected to said fourth star wheel and having its second end mechanically and operatively and adjacently connected to said closing machine and second end being disposed a substantial distance from said rinsing machine.

9. The bottle filling plant according to claim 8, wherein:

each of said first, top, connecting element, said second, top, connecting element, said third, top, connecting element, said first, bottom, connecting element, said second, bottom, connecting element, and said third, bottom, connecting element are at least virtually exactly horizontal; and each of said first, top, connecting element, said second, top, connecting element, said third, top, connecting element, said first, bottom, connecting element, said second, bottom, connecting element, and said third, bottom, connecting element have all surfaces disposed at an angle with respect to the horizontal and, thus, have no horizontal surfaces.

10. The bottle filling plant according to claim 9, wherein:

said plurality of oblong connecting elements further comprising a fifth, bracing, set of connecting elements being disposed and configured to minimize collection of contaminants and facilitate cleaning of said connecting elements and having a length dimension being disposed substantially horizontally;

said fifth, bracing, set of connecting elements comprising a first, bracing, connecting element having a length dimension being disposed substantially horizontally;

said first, bracing, connecting element being disposed between and mechanically and operatively connected to at least two of: said first star wheel, said second star wheel, said third star wheel and said fourth star wheel.

11. The bottle filling plant according to claim 10, wherein said bottle filling plant comprising at least one of (A), (B), (C), (D), (E), and (F):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element; and (F) said at least one said oblong connecting element being disposed between and mechanically and operatively connected to at least one of: said filling machine, said closing machine, and said rinsing machine and their corresponding transport elements.

12. The bottle filling plant according to claim 11, wherein said bottle filling plant comprising all of (A), (B), (C), (D), (E), and (F):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element; and (F) said at least one said oblong connecting element being disposed between and mechanically and operatively connected to at least one of: said filling machine, said closing machine, and said rinsing machine and their corresponding transport elements.

13. A container filling plant for filling containers with a filling material, said container filling plant comprising:

a plurality of machines;

said plurality of machines comprising at least a filling machine and a closing machine;

a first moving arrangement being configured and disposed to move containers to said filling machine;

said filling machine being configured and disposed to fill empty containers with a filling material;

said filling machine comprising:

a moving device being configured and disposed to accept containers from said first moving arrangement and to move containers within said filling machine;

an apparatus being configured and disposed to hold containers during filling; and at least one filling device being configured and disposed to fill containers with a filling material upon the containers being within said filling machine;

a second moving arrangement being configured and disposed to accept filled containers from said moving device of said filling machine to move filled containers out of said filling machine;

said second moving arrangement being configured and disposed to move filled containers from said filling machine to said closing machine;

said closing machine being configured and disposed to close filled containers;

said closing machine comprising:

a moving device being configured and disposed to accept filled containers from said second moving arrangement and to move filled containers within said closing machine;

an apparatus being configured and disposed to hold filled containers during closing; and at least one closing device being configured and disposed to close filled containers upon the filled containers being within said closing machine;

a third moving arrangement being configured and disposed to accept closed containers from said moving device of said closing machine to move closed containers out of said closing machine;

a plurality of oblong connecting elements each being disposed and configured to minimize collection of contaminants and facilitate cleaning of said connecting elements;

each of said plurality of oblong connecting elements comprising a first end and a second end;

each of said plurality of oblong connecting elements comprising a length, a width, and a thickness, said length of each of said plurality of oblong connecting elements being substantially greater than either of its width and its thickness;

said width and said thickness being sufficiently great to provide sufficient rigidity to said connecting elements to hold said machines sufficiently rigidly with respect to one another to minimize movement of said machines with respect to one another and to minimize misalignment of said machines with respect to one another during operation;

each said first end being disposed at one end of said length of its oblong connecting element and each said second end being disposed at the other end of said length of its oblong connecting element opposite and most distantly disposed from said first end;

said plurality of oblong connecting elements comprising:

a first, top, connecting element having a length dimension being disposed substantially horizontally;

said first, top, connecting element being disposed between and mechanically and operatively connected to said filling machine and to said closing machine and having its first end mechanically and operatively connected to said filling machine and having its second end mechanically and operatively connected to said closing machine;

said plurality of oblong connecting elements further comprising:

a first, bottom, connecting element having a length dimension being disposed substantially horizontally;

said first, bottom, connecting element being disposed between and mechanically and operatively connected to said filling machine and to said closing machine and having its first end mechanically and operatively connected to said filling machine and having its second end mechanically and operatively connected to said closing machine;

said first, bottom, connecting element being disposed immediately below, and at a substantial distance from, said first, top, connecting element;

said plurality of oblong connecting elements still further comprising:

a first, angled, connecting element being disposed between and being mechanically and operatively connected to said filling machine and said closing machine and having its first end mechanically and operatively connected to said filling machine and having its second end mechanically and operatively connected to said closing machine;

said first, angled, connecting element being operatively and mechanically connected to said first, top, connecting element and said first, bottom, connecting element; and said first, angled, connecting element having its length being disposed at a non-zero acute angle with respect to the length of said first, top, connecting element and the length of said first, bottom, connecting element;

said first, top, connecting element, said first, bottom, connecting element, and said first, angled, connecting element being disposed with respect to one another to at least substantially form a z-shaped configuration;

and one of (i) and (ii), wherein:

(i) said filling machine, said first, top, connecting element and said first, angled, connecting element being disposed with respect to one another to form a substantially triangular structure to provide sufficient rigidity to hold said machines sufficiently rigidly with respect to one another to minimize movement of one machine with respect to another machine to minimize misalignment of said machines with respect to one another during operation; and said closing machine, said first, bottom, connecting element, and said first, angled, connecting element being disposed with respect to one another to form a substantially triangular structure to provide sufficient rigidity to hold said machines sufficiently rigidly with respect to one another to minimize movement of one machine with respect to another machine to minimize misalignment of said machines with respect to one another during operation; and (ii) said filling machine, said first, bottom, connecting element, and said first, angled, connecting element being disposed with respect to one another to form a substantially triangular structure to provide sufficient rigidity to hold said machines sufficiently rigidly with respect to one another to minimize movement of one machine with respect to another machine to minimize misalignment of said machines with respect to one another during operation; and said closing machine, said first, top, connecting element, and said first, angled, connecting element being disposed with respect to one another to form a substantially triangular structure to provide sufficient rigidity to hold said machines sufficiently rigidly with respect to one another to minimize movement of one machine with respect to another machine to minimize misalignment of said machines with respect to one another during operation;

substantial portions of said oblong connecting elements are disposed away from and at a substantial distance from one another; and said first, top, connecting element, said first, bottom, connecting element, and said first, angled, connecting element providing substantial rigidity between said machines above floor level and to provide sufficient rigidity to hold said machines sufficiently rigidly with respect to one another and to minimize movement of said machines with respect to one another and to minimize misalignment of said machines with respect to one another during operation.

14. The container filling plant according to claim 13, wherein:

said plurality of machines comprising a third machine;

said plurality of oblong connecting elements comprising:

a second, top, connecting element having a length dimension being disposed substantially horizontally;

said second, top, connecting element being disposed between and mechanically and operatively connected to said closing machine and said third machine and having its first end mechanically and operatively connected to said closing machine and having its second end mechanically and operatively connected to said third machine;

said plurality of oblong connecting elements further comprising:

a second, bottom, connecting element having a length dimension being disposed substantially horizontally;

said second, bottom, connecting element being disposed between and mechanically and operatively connected to said closing machine and to said third machine and having its first end mechanically and operatively connected to said closing machine and having its second end mechanically and operatively connected to said third machine;

said second, bottom, connecting element being disposed immediately below, and at a substantial distance from, said second, top, connecting element;

said plurality of oblong connecting elements further comprising:

a third, top, connecting element having a length dimension being disposed substantially horizontally;

said third, top, connecting element being disposed between and mechanically and operatively connected to said third machine and to said filling machine and having its first end mechanically and operatively connected to said third machine and having its second end mechanically and operatively connected to said filling machine;

said plurality of oblong connecting elements further comprising:

a third, bottom, connecting element having a length dimension being disposed substantially horizontally;

said third, bottom, connecting element being disposed between and mechanically and operatively connected to said third machine and to said filling machine and having its first end mechanically and operatively connected to said third machine and having its second end mechanically and operatively connected to said filling machine; and said third, bottom, connecting element being disposed immediately below, and at a substantial distance from, said third, top, connecting element.

15. The container filling plant according to claim 14, wherein:

each of said first, top, connecting element, said second, top, connecting element, said third, top, connecting element, said first, bottom, connecting element, said second, bottom, connecting element, and said third, bottom, connecting element are at least virtually exactly horizontal; and each of said first, top, connecting element, said second, top, connecting element, said third, top, connecting element, said first, bottom, connecting element, said second, bottom, connecting element, and said third, bottom, connecting element have all surfaces disposed at an angle with respect to the horizontal and, thus, have no horizontal surfaces.

16. The container filling plant according to claim 15, wherein:

said container filling plant further comprising at least a first, supporting, connecting element having a length dimension being disposed substantially horizontally; and said at least a first, supporting, connecting element being mechanically and operatively connected to, and being configured to receive and support, at least one of said first moving arrangement, said second moving arrangement, and said third moving arrangement.

17. The container filling plant according to claim 16, wherein:

said container filling plant further comprising a second, supporting, connecting element having a length dimension being disposed substantially horizontally;

said second, supporting, oblong connecting element comprising a first end being mechanically and operatively connected to said second moving arrangement and a second end being mechanically and operatively connected to said closing machine;

said container filling plant further comprising a third, supporting, connecting element having a length dimension being disposed substantially horizontally; and said third, supporting, oblong connecting element comprising a first end being mechanically and operatively connected to said third moving arrangement and a second end being mechanically and operatively connected to said closing machine.

18. The container filling plant according to claim 17, wherein:

said plurality of oblong connecting elements further comprising a first, bracing, connecting element having a length dimension being disposed substantially horizontally;

said first, bracing, connecting element being disposed between and mechanically and operatively connected to at least two of: said first moving arrangement, said second moving arrangement, and said third moving arrangement;

said first, supporting, oblong connecting element having said first end mechanically and operatively connected to said first moving arrangement and having its second end mechanically and operatively connected to said third, top, oblong connecting element;

said container filling plant further comprising:

a fourth moving arrangement being configured and disposed to move containers to said third machine; and a fourth, supporting, connecting element having a length dimension being disposed substantially horizontally;

said fourth, supporting, oblong connecting element having its first end mechanically and operatively connected to said fourth moving arrangement and having its second end mechanically and operatively connected to said second, top, connecting element; and each of said first, supporting, connecting element, said second, supporting, connecting element, said third, supporting, connecting element, and said fourth, supporting, connecting element have all surfaces disposed at an angle with respect to the horizontal and, thus, have no horizontal surfaces.

19. The container filling plant according to claim 18, wherein said container filling plant comprising at least one of (A), (B), (C), (D), (E), (F), and (G):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element;

(F) said at least one said oblong connecting element being disposed between and mechanically and operatively connected to at least one of: said filling machine, said closing machine, and said third machine and their corresponding transport elements; and (G) said at least one of: said first moving arrangement, said second moving arrangement, said third moving arrangement, and said fourth moving arrangement comprising a star wheel.

20. The container filling plant according to claim 19, wherein said container filling plant comprising all of (A), (B), (C), (D), (E), (F), (G), (H), and (I):

(A) said at least one oblong connecting element has an external surface that is angled and/or inclined and/or circular and/or convexly curved;

(B) said at least one end of said at least one oblong connecting element comprising an element for the orientation and/or adjustment of said at least one oblong connecting element and/or of said machines;

(C) said at least one oblong connecting element being fastened to the foundation rings of the container handling machines;

(D) said machines further comprising covering elements for the covering or housing of said machines, and said covering elements directly or indirectly fastened to said at least one oblong connecting element;

(E) said at least one oblong connecting element is a flat element;

(F) said at least one said oblong connecting element being disposed between and mechanically and operatively connected to at least one of: said filling machine, said closing machine, and said third machine and their corresponding transport elements;

(G) said at least one of: said first moving arrangement, said second moving arrangement, said third moving arrangement, and said fourth moving arrangement comprising a star wheel;

(H) said substantial portions of said oblong connecting elements are separated substantially only by air; and (I) the distance between said first, bottom connecting element and said first, top, connecting element is at least substantially similar to the length of either of said first, bottom, connecting element and said first, top, connecting element;

the distance between said second, bottom, connecting element and said second, top, connecting element is at least substantially similar to the length of either of said second, bottom, connecting element and said second, top, connecting element; and the distance between said third, bottom connecting element and said third, top, connecting element is at least substantially similar to the length of either of said third, bottom, connecting element and said third, top, connecting element.

* * * * *